US005364044A

United States Patent [19]

Welp et al.

[11] Patent Number: 5,364,044

[45] Date of Patent: Nov. 15, 1994

[54] AIR-CUSHION ROLL SUPPORT IN ROLL-MAKING MACHINE

[75] Inventors: Ewald G. Welp, Erkrath; Erhard Milke, Langenfeld, both of Germany

[73] Assignee: Jagenberg Aktiengesellschaft, Dusseldorf, Germany

[21] Appl. No.: 77,209

[22] Filed: Jun. 14, 1993

[30] Foreign Application Priority Data

Jun. 13, 1992 [DE] Germany ..... 4219415

[51] Int. Cl.[5] ..... B65H 18/16; B65H 19/30

[52] U.S. Cl. ..... 242/530.4; 242/533; 242/541; 242/908

[58] Field of Search ..... 242/56.4, 56.5, 56.6, 242/56.2, 65, 56.9

[56] References Cited

U.S. PATENT DOCUMENTS 4,749,140 6/1988 Ruff ..... 242/56.4

5,000,395 3/1991 Welp et al. ..... 242/56.4

FOREIGN PATENT DOCUMENTS 4201815 7/1993 Germany .

*Primary Examiner*—John M. Jillions

*Attorney, Agent, or Firm*—Herbert Dubno; Andrew Wilford

[57] ABSTRACT

An apparatus for making a plurality of relatively narrow rolls of paper from a relatively wide band of paper has a relatively wide main roller to which is fed strips cut from the wide paper band. A plurality of pairs of support heads are arranged in two rows extending along the main roller with the rows spaced angularly from each other. Each pair of support heads is spaced in the respective row axially from the other support heads of the respective row and each pair of support heads is adapted to engage in an end of a respective roll core about which a respective one of the strips is wound. A drive rotates the main roller and thereby winds the strips up on the respective roll cores. Respective elongated supports extend axially along the main roller adjacent the rows of support heads and can be raised and lowered. A respective blower box at each of the rolls has an upwardly open mouth snugly engageable with the respective roll held in the respective pair of holders. Respective structures carrying the blower boxes on the respective supports can displace them between a use position engaging vertically upward beneath the respective roll and an out-of-use position laterally offset outward from the use position. Air is ejected from the mouths of the blower boxes to at least partially support the respective rolls via respective air cushions on the respective blower boxes.

7 Claims, 3 Drawing Sheets

AIR-CUSHION ROLL SUPPORT IN ROLL-MAKING MACHINE

FIELD OF THE INVENTION

The present invention relates to a machine used to cut a wide band of paper into a plurality of parallel strips and to wind each of these strips into a respective roll. More particularly this invention concerns a system for supporting the rolls on an air cushion in such a machine.

BACKGROUND OF THE INVENTION

As described in German patent application P 4,201,815 it is known to form rolls of paper, which term is here intended to cover all forms of paper, cardboard, and like material, in an apparatus having a relatively wide main roller rotatable about and centered on a main axis and a plurality of pairs of support heads arranged in two rows extending along the main roller with the rows spaced angularly from each other relative to the main axis. Each pair of support heads is spaced in the respective row axially from the other support heads of the respective row and each pair of support heads is adapted to engage in an end of a roll core about which a respective narrow strip is wound. Two respective beams extend axially along the main roller underneath the respective rows of support heads substantially the full length of the main roller. A respective blower box provided for each roll has an upwardly open mouth snugly engageable with the roll held in the respective pair of holders.

Such a machine is used to make rolls by first longitudinally slitting a wide paper band into relatively narrow strips and feeding same to the main roller with the strips axially closely juxtaposed while rotating the main roller to wind the strips up on the respective roll cores. The blower boxes are lifted up to fit the respective mouths to the respective roll and air is ejected from the mouths of the blower boxes to at least partially support the respective rolls via respective air cushions on the respective blower boxes, thereby relieving the holders and the main roller of some of this load. When each narrow roll is complete, it is unloaded by releasing it from the holders and then lowering the beams and the blower boxes carried thereby. Once down generally at floor level a crane or special-duty fork lift can pick off and carry away the finished narrow rolls.

Such an apparatus is fairly complex in construction and operation.

OBJECTS OF THE INVENTION

It is therefore an object of the present invention to provide an improved air-cushion support system for a roll-making machine.

Another object is the provision of such an improved air-cushion support system for a roll-making machine which over-comes the above-given disadvantages, that is which is relatively simple to use and operate.

A further object is to provide an improved method of operating such a roll-making machine having air-cushion support for the rolls being made up.

SUMMARY OF THE INVENTION

An apparatus for making a plurality of relatively narrow rolls of paper from a relatively wide band of paper has according to the invention a relatively wide main roller rotatable about and centered on a main axis and to which is fed strips cut from the wide paper band.

A plurality of pairs of support heads are arranged in two rows extending along the main roller with the rows spaced angularly from each other relative to the main axis. Each pair of support heads is spaced in the respective row axially from the other support heads of the respective row and each pair of support heads is adapted to engage in an end of a respective roll core about which a respective one of the strips is wound. A drive rotates the main roller and thereby winds the strips up on the respective roll cores. Two respective elongated supports extend axially along the main roller adjacent the respective rows of support heads and can be raised and lowered. A respective blower box at each of the rolls has an upwardly open mouth snugly engageable with the respective roll held in the respective pair of holders. Respective structures carrying the blower boxes on the respective supports can displace them between a use position engaging vertically upward beneath the respective roll and an out-of-use position laterally offset outward from the use position. Air is ejected from the mouths of the blower boxes to at least partially support the respective rolls via respective air cushions on the respective blower boxes.

Thus with this system when the winding is done the blower boxes can be parked completely out of the way. In fact they can be pulled into an elevated position giving free access to the side of the rolling machine.

The roll-making apparatus according to the invention further has a slide displaceable axially along the respective elongated supports, an arm having an outer end pivoted on the respective slide and an inner end on which the respective box is pivoted, and an actuator braced between the arm and the respective box for pivoting same on the respective arm about the respective inner arm end. These slides are aligned with the rolls being made up at the start of each rolling operation, after the slitters and holders are set.

The roll-making apparatus further has according to the invention respective beams extending axially along the main roller underneath the rows of support heads and extending substantially the full length of the main roller, means for raising and lowering the beams and for thereby pressing the boxes against the respective rolls when the beams are in the use position. These beams therefore serve double duty, holding the boxes in place against the rolls and unloading the finished rolls.

In accordance with further features of the invention the roll-making apparatus has respective holddown arms each having an outer end pivoted on the respective slide and an inner end engageable downwardly against the respective roll, and a respective actuator engaged between each holddown arm and the respective slide for pressing the inner end of the respective holddown arm down against the respective roll. These holddown arms ensure that each roll engages the main roller solidly enough for good winding and compaction of the strip being wound up even before the roll weighs enough to do so by its own mass.

Each box according to the invention is pivoted on each arm at a location lying generally on the circumference of the respective roll so that each box can pivot to follow an increase in diameter of the respective roll. This greatly simplifies operation of the system.

The method of operating an apparatus for making a plurality of relatively narrow rolls of paper from a relatively wide strip of paper according to the invention comprises the steps of longitudinally slitting the wide paper strip into relatively narrow strips of papers and feeding same to the main roller with the strips axially closely juxtaposed, rotating the main roller and thereby winding the strips up on the respective roll cores, positioning each blower box by means of its structure in the use position, raising each blower box by means of the respective beam and thereby fitting the respective mouth to the respective roll, ejecting air from the mouths of the blower boxes and thereby at least partially supporting the respective rolls via respective air cushions on the respective blower boxes.

In addition to unload the finished rolls each blower box is dropped down away from the respective roll by lowering the respective beam and thereby disengaging the respective mouths from the respective rolls. Then each blower box is displaced by means of its structure into the out-of-use position and the beams are raised to engage against the rolls. Each of the rolls is then released from the respective holder pair, and the beams are lowered to drop the rolls out from between the respective holder pairs.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
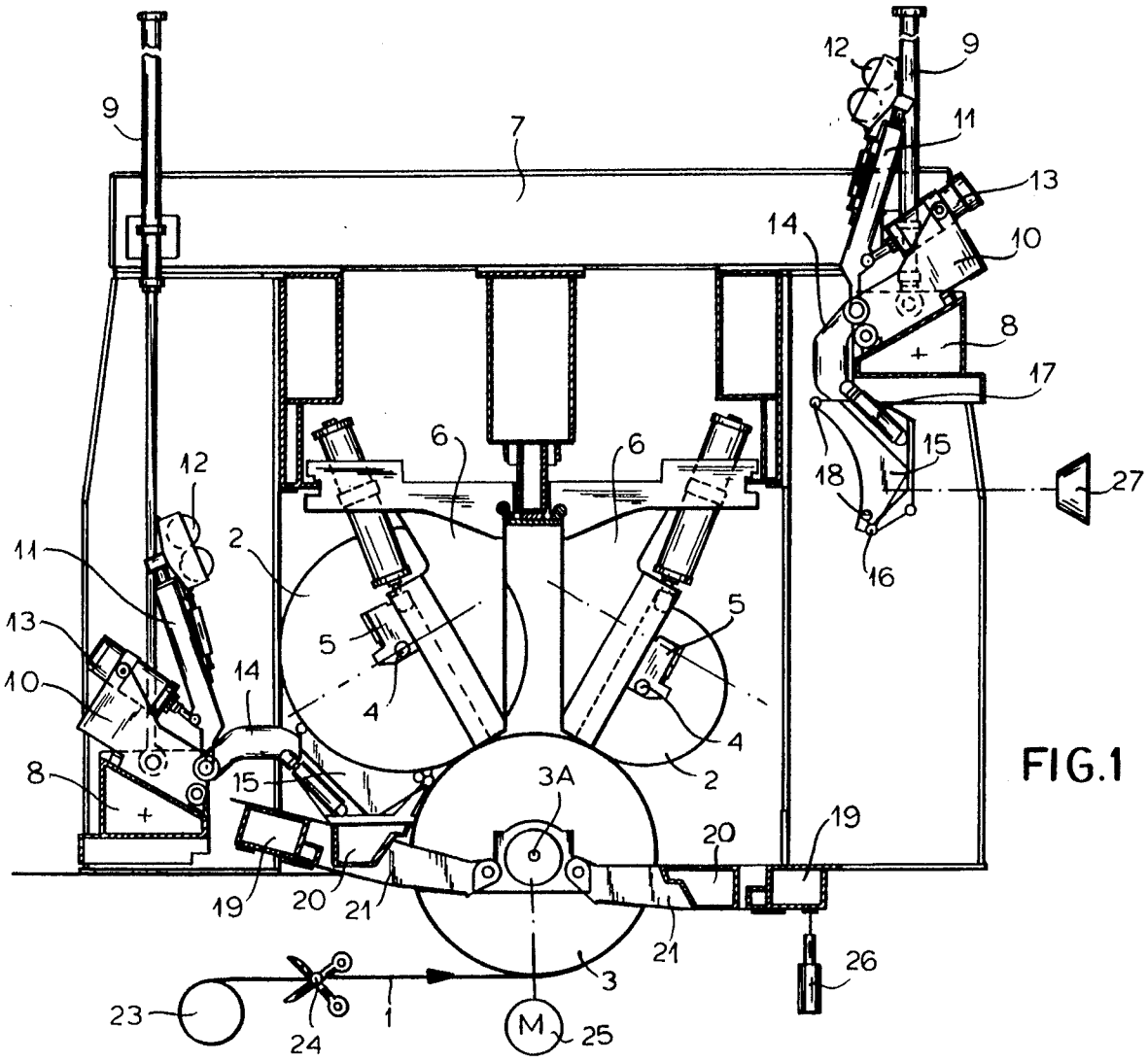
FIG. 1 is a partly schematic end sectional view of the apparatus of this invention with the right-side equipment in the out-of-use position and the left-side equipment in the use position.
Figure 2:
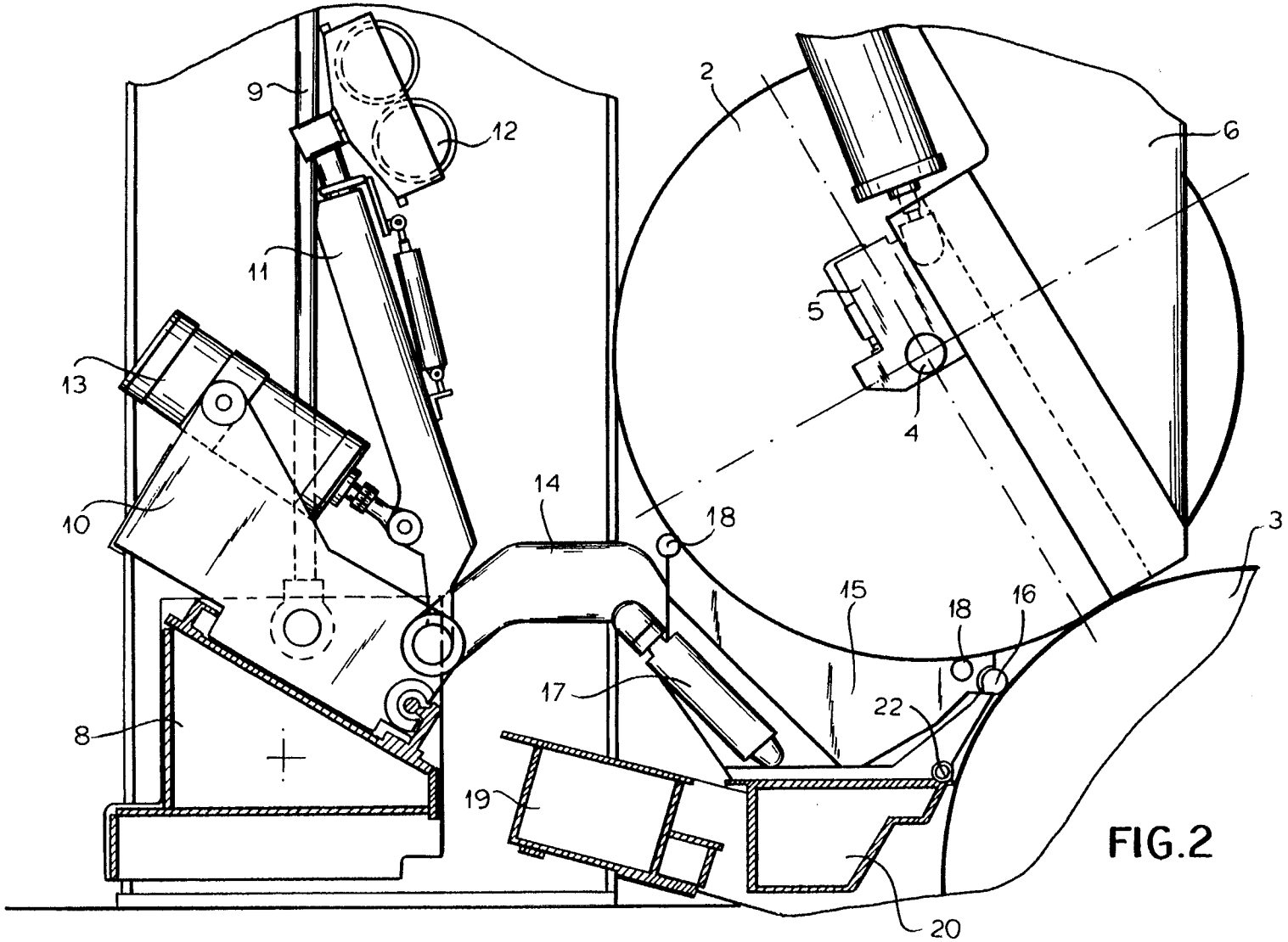
FIGS. 2 and 3 are large-scale views of details of FIG. 1.

As seen in FIG. 1 a wide paper band 1 is pulled from a supply 23 and cut by a slitter 24 into a plurality of narrow strips that are fed tangentially to a main roller 3 rotatable about a horizontal axis 3A and rotated by a motor illustrated schematically at 25. This rotation of the roller 3 winds the individual strips up into rolls 2 supported on cores each held by a pair of holder pins 4 of holders 5 mounted in holder assemblies 6 movable radially of the axis 3A on a frame 7 of the machine. The rolls 2 are arranged in two rows and bear radially inward and downward on the roller 3 so that the rotation of the roller 3 rotationally drives the rolls 2 and compresses the strips coiled in them.

Each row of the machine is provided with a beam 8 that is vertically displaceable by actuators 9 and that carries at each winding station defined by a roll 2 a holddown support 10 carrying an arm 11 whose inner end is provided with rollers 12 that can radially engage and press down a respective one of the rolls 2. This is used only during startup to ensure sufficient friction between the rolls 2 and the roller 3 for good winding and tight compression of the wound-up paper or cardboard. The holddown supports 10 can slide axially along the respective beams 8 to align them transversely with the respective rolls 2.

Each side of the apparatus has a respective two-part unloading beam 19, 20 each of whose parts 19 and 20 extends the full length of the roller 3. Each such beam 19, 20 is carried on arms 21 pivoted near the axis 3A for vertical movement of these beams 19, 20 by means of actuators shown schematically at 26. The upper surface of each of these beams 19, 20 can be either flat or form an upwardly open groove, depending on the relative angular orientation of the two beam parts 19 and 20 which have planar upper surfaces.

Each holddown support 10 is further provided with an arm 14 having an inner end formed as a roller 16 at which is pivoted a respective blower box 15 having an upwardly open mouth and an interior that is supplied with air under pressure from a source shown schematically at 27.

Each of these blower boxes 15 can be tipped about its respective axis 16, which extends parallel to the axis 3A, by a respective actuator 17 to fit rolls 2 of different diameters. Thus as the roll diameter increases, the respective actuator 17 shortens to tip back the box 15.

The mouth of each such box 15 is defined at upper and lower edges by parallel rollers 18 that actually ride on the respective roll 2. The sides are formed with soft seals whose shapes change to closely conform to the roll circumference so as to engage same with at most a very narrow gap as described in the above-cited German patent document. Thus the air fed under pressure from the source 27 will create an air cushion that will carry at least part of the load of the respective roll 2, transmitting it to the rigid beam 19, 20. This relieves the holders 5 of this stress so they do not have to be built to support very heavy loads, and also relieves the roller 3 so that same will not bend.

Figure 3:
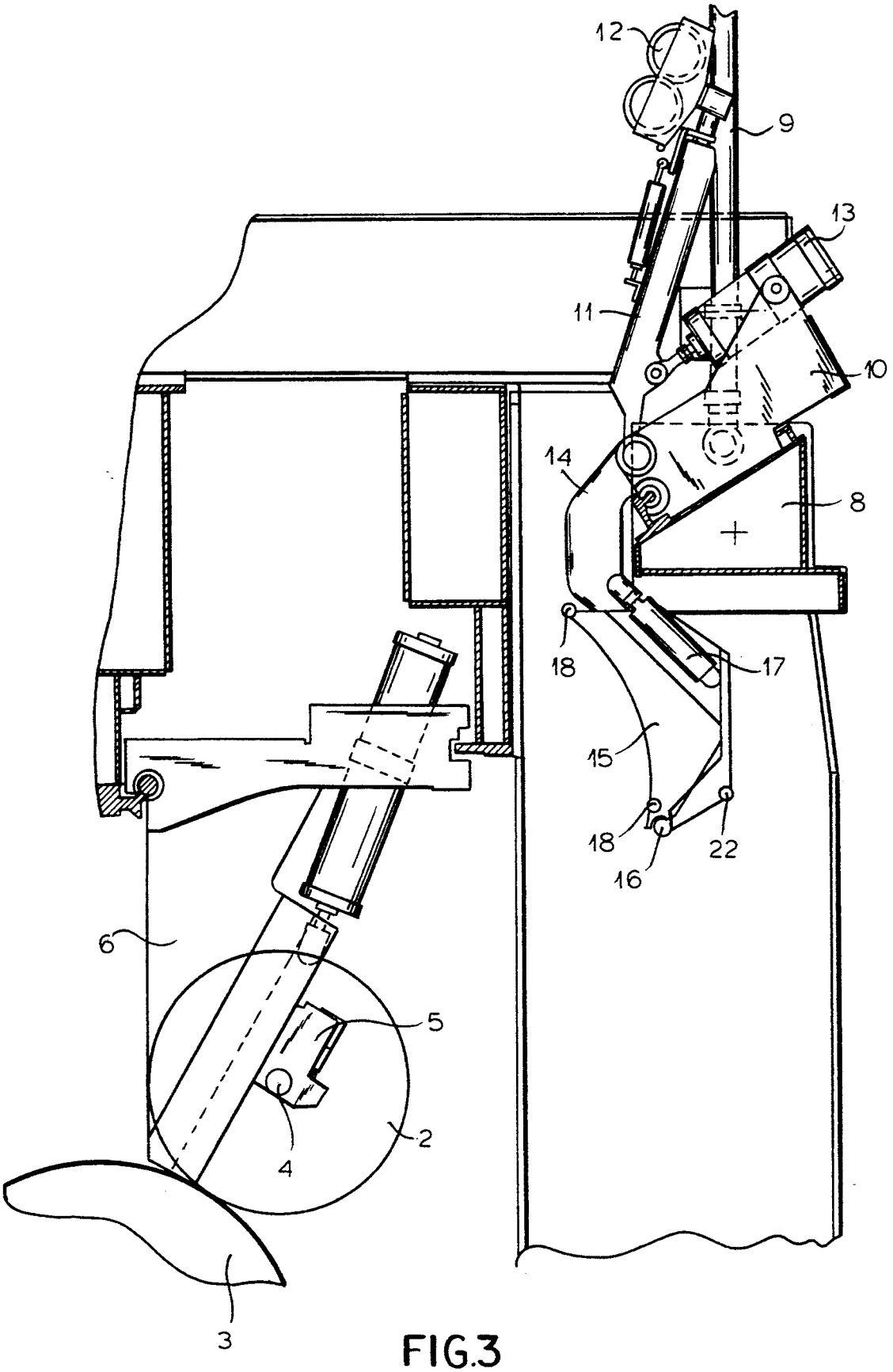

At the start of winding no air-cushion pressure relief is needed. In fact the rolls 2 each need to be held down by the respective rollers 11 to ensure sufficient friction to drive them. To this end the beam 19, 20 is put in a lowermost position, flush with the floor, and the machine is readily accessible from both sides. While in this bottom position the beams 8 are lowered by their actuators 9. As they descend the rollers 16 at the ends of the boxes 15 first strike the upper surface of the outer part 19 of the respective beam 19, 20, causing the arms 14 to pivot inward with the boxes moving into position with the inner-end rollers 18 closely radially juxtaposed with the outer surface of the roller 3. Rollers 22 outward of the rollers 16 facilitate this movement into the use position. Once the beams 8 are all the way down, the arms 11 can be lowered to stabilize the rolls 2 until they weigh enough that their weight alone can hold them in place, whereupon the arms 11 are pivoted by their actuators 13 back up into the position shown on the right-hand side of FIG. 1 and in FIG. 3.

Once the rolls reach a certain size, normally about 1000 mm in diameter, the actuators 17 pivot the boxes 15 inward to engage snugly around the respective rolls 2 and air is fed to them to pick up some of the load. As roll diameter increases, the cylinders 17 relax to allow the boxes 15 to push back, following the increasing roll size. Much of the weight of the rolls 2 is thus borne by the beams 19, 20 rather than by the holders 5 or the roller 3.

Once the rolls are finished the drive 25 is stopped and the strips cut. Then the actuators 17 are relaxed to drop the boxes 15 away from the rolls 2 and the beams 8 are raised to roll the boxes 15 back out and off the beams 19, 20, eventually lifting them all the way up into the position shown in FIG. 3 and on the right-hand side of FIG. 1 so that the entire side of the machine is left exposed. Then the actuator 26 moves the beams 19, 20 into an uppermost position in which they directly engage all the rolls 2 of the respective row. The weight of the rolls 2 is thus taken up by the beams 19, 20 and the holders 5 are moved axially away from the respective rolls 2, completely releasing them. Then the beams 19, 20 drop back down to lower the complete rolls 2 down to floor level where they can be picked up and carted off.

We claim:

1. An apparatus for making a plurality of relatively narrow rolls of paper from a relatively wide band of paper, the apparatus comprising:

a relatively wide main roller rotatable about and centered on a main axis;

means for longitudinally slitting the wide paper band into relatively narrow strips and for feeding same to the main roller with the strips axially closely juxtaposed;

a plurality of pairs of support heads arranged in two rows extending along the main roller with the rows spaced angularly from each other relative to the main axis, each pair of support heads being spaced in the respective row axially from the other support heads of the respective row and each pair of support heads being adapted to engage in an end of a respective roll core about which a respective one of the strips is wound;

drive means for rotating the main roller and thereby winding the strips up on the respective roll cores;

two respective elongated supports extending axially along the main roller adjacent the respective rows of support heads;

means for raising and lowering the supports;

a respective blower box at each of the rolls and having an upwardly open mouth snugly engageable with the respective roll held in the respective pair of holders;

means including respective structures carrying the blower boxes on the respective supports for displacing each of the boxes between a use position engaging vertically upward beneath the respective roll and an out-of-use position laterally offset outward from the use position; and means for ejecting air from the mouths of the blower boxes and thereby at least partially supporting the respective rolls via respective air cushions on the respective blower boxes.

2. The roll-making apparatus defined in claim 1 wherein the structures each include:

a slide displaceable axially along the respective elongated supports, an arm having an outer end pivoted on the respective slide and an inner end on which the respective box is pivoted, and an actuator braced between the arm and the respective box for pivoting same on the respective arm about the respective inner arm end.

3. The roll-making apparatus defined in claim 2, further comprising:

respective beams extending axially along the main roller underneath the rows of support heads and extending substantially the full length of the main roller;

means for raising and lowering the beams and for thereby pressing the boxes against the respective rolls when the beams are in the use position.

4. The roll-making apparatus defined in claim 2, further comprising:

respective holddown arms each having an outer end pivoted on the respective slide and an inner end engageable downwardly against the respective roll; and a respective actuator engaged between each holddown arm and the respective slide for pressing the inner end of the respective holddown arm down against the respective roll.

5. The roll-making apparatus defined in claim 2 wherein each box is pivoted on each arm at a location lying generally on the circumference of the respective roll, whereby each box can pivot to follow an increase in diameter of the respective roll.

6. A method of operating an apparatus for making a plurality of relatively narrow rolls of paper from a relatively wide strip of paper, the apparatus comprising:

a relatively wide main roller rotatable about and centered on a main axis;

a plurality of pairs of support heads arranged in two rows extending along the main roller with the rows spaced angularly from each other relative to the main axis, each pair of support heads being spaced in the respective row axially from the other support heads of the respective row and each pair of support heads being adapted to engage in an end of a roll core about which a respective narrow strip is wound;

two respective beams extending axially along the main roller underneath the respective rows of support heads substantially the full length of the main roller;

two respective supports extending axially along the main roller adjacent the respective rows of support heads;

means for raising and lowering the supports;

a respective blower box at each of the rolls and having an upwardly open mouth snugly engageable with the respective roll held in the respective pair of holders;

respective structures carrying the blower boxes on the respective supports and operable for displacing each of the boxes between a use position vertically between the respective roll and the respective beam and an out-of-use position laterally offset from the use position the respective pair of holders, the method comprising the steps of longitudinally slitting the wide paper strip into relatively narrow strips of papers and feeding same to the main roller with the strips axially closely juxtaposed;

rotating the main roller and thereby winding the strips up on the respective roll cores;

positioning each blower box by means of its structure in the use position;

raising each blower box by means of the respective beam and thereby fitting the respective mouth to the respective roll:

ejecting air from the mouths of the blower boxes and thereby at least partially supporting the respective rolls via respective air cushions on the respective blower boxes.

7. The method defined in claim 6, further comprising the steps for unloading the finished rolls of lowering each blower box by lowering the respective beam and thereby disengaging the respective mouths from the respective rolls;

displacing each blower box by means of its structure into the out-of-use position;

raising the beams to engage same against the rolls;

releasing each of the rolls from the respective holder pair; and lowering the beams to drop the rolls out from between the respective holder pairs.

* * * * *